US005677503A

United States Patent [19]

Kurata

[11] Patent Number: 5,677,503

[45] Date of Patent: Oct. 14, 1997

[54] TONE GENERATOR

[75] Inventor: Mitsuhiro Kurata, Hamamatsu, Japan

[73] Assignee: Yamaha Corporation, Hamamatsu, Japan

[21] Appl. No.: 540,303

[22] Filed: Oct. 6, 1995

[30] Foreign Application Priority Data

Oct. 7, 1994 [JP] Japan ..... 6-243937

[51] Int. Cl.[6] ..... G10H 7/00; G10H 7/06

[52] U.S. Cl. ..... 84/604; 84/622; 84/659

[58] Field of Search ..... 84/622–627, 604–607, 84/659

[56] References Cited

U.S. PATENT DOCUMENTS 5,194,681 3/1993 Kudo ..... 84/603

5,512,896 4/1996 Read et al. ..... 341/65

*Primary Examiner*—William M. Shoop, Jr.

*Assistant Examiner*—Marlon Fletcher

*Attorney, Agent, or Firm*—Loeb & Loeb LLP

[57] ABSTRACT

A tone generator has a waveform memory which stores waveform data at least having a loop section defined by a loop start address and a loop end address for repetitive reading out. An address-generating circuit generates a readout address by which the waveform data is read out from the waveform memory and delivers the readout address to the waveform memory to read out the waveform data from the waveform memory. A bit mask circuit masks a predetermined range of more significant bits of the readout address to generate a bit-masked address value. When it is determined that the readout address falls outside the loop section at least at one side of the loop start address and the loop end address of the loop section, a looping readout address generated by the use of the bit-masked address value is delivered as the readout address.

40 Claims, 8 Drawing Sheets

MODULATING SIGNAL
1
20
WAVEFORM MEMORY
21
READOUT BUFFER
MUSICAL TONE SIGNAL
18
15
SEL
0
1
14
13
BIT MASK CIRCUIT
12
+
-
16
SIGN
ACCUMULATOR
11
17
S
R
SA
LSA
CARRY CONTROL
LEA
KON
F-NO
INTERFACE
10
FROM CONTROL BLOCK

TONE GENERATOR

BACKGROUND OF THE INVENTION

1. Field of the Invention

This invention relates to a tone generator of the waveform memory type, and more particularly to a tone generator of this type which performs improved loop processing of waveform data read out from a waveform memory and FM-modulated in a manner shifting the readout address forward and backward alternately according to modulating waveform data.

2. Prior Art

Conventionally, tone generators in general include ones employing the FM method (FM tone generators) and ones employing the waveform memory method (waveform memory tone generators). Conventional FM tone generators use simple waveforms, such as a sinusoidal wave, as an operator. On the other hand, conventional waveform memory tone generators are constructed such that waveform data are read out from a waveform memory according to a readout address which simply steps forward, i.e. advances step by step. A tone generator which is a combination of the two methods has been proposed, in which certain waveform data stored in a waveform memory is used as a desired operator for the FM tone generator to synthesize a musical tone signal in order to impart variations or enrichment to the tone color of generated musical tones. Further, waveform memory tone generators in general employ loop reading such that a loop section is provided for waveform data, which extends between a loop start address and a loop end address to repeatedly read out data from the loop section, thereby enabling continuous reading-out of the waveform data over a long duration.

FIG. 1 shows the arrangement of an example of the conventional FM tone generator which utilizes a waveform memory. In this tone generator, a modulating signal and a start address SA are added to a stepping relative address generated by an address generator 49 to generate an absolute address (readout address: see FIG. 2) which advances in a manner shifting forward and backward alternately. The readout address thus generated is input to a waveform memory 20, whereby waveform data stored at a location corresponding to the input address is read out from the memory. The waveform data is comprised of non-repetitive waveform data stored in an area of the waveform memory between a start address SA and a loop start address LSA for non-repetitive reading, and loop waveform data stored in an area of the same between the loop start address LSA and a loop end address LEA for loop or repetitive reading. The address generator 49 generates, as the aforementioned "stepping relative address", an address value which steps forward or advances starting with "0", and when the generated address value reaches the loop end address LEA, the address generator 49 resets the address value to the loop start address LSA. So long as the reading-out of the waveform data is continued, the address generator 49 repeatedly generates the address value stepping from the loop start address LSA to the loop end address LEA, as the stepping relative address.

The illustrated tone generator performs 16-channel time-shared operations, and waveform data read from the waveform memory 20 for all the channels are once stored into a readout buffer 21. When this tone generator functions as an FM tone generator, waveform data assigned to one of the time-shared channels is used as a modulating signal (modulator), and waveform data assigned to another time-shared channel is used as a carrier. The former waveform data used as the modulating signal is read out from the readout buffer 21 and delivered into the time-shared channel of the latter waveform data used as the carrier, whereby the former data is added to the readout address of the latter waveform data. Now, the construction and operation of one of the time-shared channels of the conventional tone generator will be described in detail.

Tone color data and performance data are input from a control block, not shown, to an interface 40. The tone color data is comprised of the start address SA, the loop start address LSA, the loop end address LEA, etc. The start address SA is an absolute address indicative of the start of a memory area in which waveform data of a specific tone color is stored. The loop start address LSA is a relative address with respect to the start address SA, which is indicative of the start of the loop section. The relative address means an address value counted from the start address SA assuming that the start address SA is "0". The loop end address LEA is a relative address indicative of the end of the loop section with respect to the start address SA. The performance data is comprised of an F number data F-NO which corresponds to the pitch of a tone of the data, more specifically, assumes a value proportional to the frequency of the pitch of the tone. The F number data F-NO determines a stepping increment by which the address generator 49 stepwise advances the address. When the performance data is input, the interface 40 delivers the F number data F-NO to an accumulator 41. The accumulator 41 accumulates the F number data F-NO in response to clock pulses applied thereto. The accumulator 41 delivers the cumulative value as stepping data (stepping relative address) to an adder 45 via a selector 44. The adder 45 adds a modulating signal to the stepping data. The modulating signal is obtained from waveform data of another time-shared channel and read into the present time-shared channel through the readout buffer 21. The sum of the stepping data and the modulating signal is delivered from the adder 45 to another adder 46, where the sum is added to the start address SA. Thus, a readout address for reading waveform data of the specific tone color from the waveform memory 20 is obtained. The waveform memory 20 is accessed by the readout address thus generated, whereby the waveform data is read out and loaded into the readout buffer 21 for temporary storage therein for sounding.

On the other hand, the stepping data delivered from the accumulator 41 is also input to an adder (subtractor) 42, where the loop end address LEA (given as a relative address with respect to the starting address SA assumed to have an address value of "0") is subtracted from the input stepping data, and the resulting difference is input to an adder 43. The adder 43 adds the loop start address LSA to the difference. The loop start address LSA is also given as a relative address with respect to the start address SA having the address value of "0". The output from the adder 43 is supplied to the selector 44 as loop data. Further, data indicative of the sign of the difference as a result of the calculation by the adder 42 is delivered to the accumulator 41 through a loading terminal thereof as well as to the selector 44 through a loading terminal thereof.

The stepping data is increased with the accumulation of the F number data F-NO by the accumulator 41. When the increased stepping data exceeds the loop end address LEA, the difference from the adder 42 turns into a positive value, and at the same time data indicative of a positive sign is delivered from the adder 42 to the accumulator 41 and the selector 44. Responsive to the positive sign data, the selector 44 selects the loop data instead of the stepping data to apply the selected loop data to the adder 45, while the accumulator 41 is loaded with this loop data as preset data. Thereafter, the accumulator 41 accumulates the F number data F-NO by initially adding the data F-NO to this loop data to deliver the resulting stepping data. Thus, the conventional tone generator operates to repeatedly reset the stepping data to the loop start address LSA whenever the stepping data reaches the loop end address LEA, thereby repeatedly performing loop operation.

However, according to the arrangement of the tone generator described above, the accumulator 41 merely simply increases the stepping data from the loop start address LSA to the loop end address LEA. As a result, the conventional tone generator cannot cope with a case where the addition of the modulating signal to the stepping data results in a readout address value which shifts forward and a backward such that the readout address value comes before the loop start address LSA or past the loop end address LEA, without previously storing loop waveform data corresponding to the width of the maximum shift that can be caused by the modulating signal at locations just before the loop start address and after the loop end address as shown in FIG. 2. Therefore, the conventional tone generator requires provision of an extra amount of memory capacity.

SUMMARY OF THE INVENTION

It is the object of the invention to provide a tone generator which is capable of performing FM modulation based on waveform data, by the use of a waveform memory with the minimum capacity.

To attain the object, the invention provides a tone generator comprising:

a memory that stores waveform data at least having a loop section defined by a loop start address and a loop end address for repetitive reading out;

an address-generating device that generates a readout address by which the waveform data is read out from the memory and that delivers the readout address for reading the waveform data from the memory;

a bit mask device that masks a predetermined range of more significant bits of the readout address and that generates a bit-masked address value;

a determining device that determines whether the readout address is within the loop section; and an address loop device that generates a looping readout address by the use of the bit-masked address value and delivers the looping readout address as the readout address, when the determining device determines that the readout address falls outside the loop section at least at one side of the loop start address and the loop end address.

According to the tone generator of the invention, during looping processing of the waveform data, when it is determined that the readout address generated by the address-generating means falls outside the loop section at at least one side of the loop start address and the loop end address, the address loop means delivers the looping readout address prepared by the use of the bit-masked address value. Therefore, the present tone generator dispenses with an extra memory for storing extra portions of the waveform data, and it is possible to carry out looping processing in a simplified manner.

Specifically, the loop start address is set to a value of $m\times2^n$ and the loop end address is set to a value of $(m+1)\times2^n$ to define the loop section having a memory size of $2^n$, and the bit mask device sets n+1-th and more significant bits of the readout address to 0 to thereby prepare the bit-masked address value.

In one preferred embodiment, when the determining device determines that the readout address exceeds the loop end address, the address loop device adds the value of $m\times2^n$ of the loop start address to the bit-masked address value and delivers the sum as the looping readout address.

In this preferred embodiment, the memory stores loop waveform data having addresses expressed in binary numbers. The waveform data has a loop waveform data section which is read from its top (loop start address) to tail (loop end address), and then returns to its top again, thus permitting repeated reading-out of waveform data therefrom. The size of this loop waveform data section is 2n in terms of the number of addresses, and the loop start address is equal to $m\times2^n$. That is, the loop start address assumes a value equal to an integer (m) multiple of the of the size of the loop waveform data section. Accordingly, the loop end address is equal to $(m+1)\times2^n$. When the loop start address is compared with the loop end address, the less significant n bits are equal to each other, and the loop end address has a larger value in the n+1-th and more significant bits.

When the determining device determines that the readout address exceeds the loop start address, the address loop device sets and holds the n+1-th and more significant bits to and at 0, and adds the value of $m\times2^n$ of the loop address to the resulting value of the readout address, and delivers the sum as the looping readout address. Now, reference is made to FIG. 3 which illustrates an example of n being set to 6. Let it be assumed, for example, that the readout address exceeds the loop end address LEA(xxxx10000000) to be xxxx10001011, then the n+1-th and more significant bits, i.e. seventh and more significant bits of the readout address are masked, i.e. set to held at 0. The resulting address value is 000000001011. The sum of this address value and the loop start address LSA, i.e. xxxx01000000 is equal to xxxx01001011, which is within the loop waveform data section defined by the loop start address LSA and the loop end address LEA.

In another preferred embodiment, when the determining device determines that the readout address falls below the loop start address, the address loop device adds the value of $m\times2^n$ of the loop start address to the bit-masked address value and delivers the sum as the looping readout address.

According to this preferred embodiment, when the determining device determines that the readout address falls below the loop start address, the address loop device sets and holds the n+1-th and more significant bits to and at 0, and adds the value of $m\times2^n$ of the loop address to the resulting value of the readout address, and delivers the sum as the looping readout address. Reference is made again to FIG. 3. When the readout address prepared during looping processing becomes equal to xxxx00110100 below the loop start address LSA(xxxx01000000), then the n+1-th and more significant bits, i.e. seventh and more significant bits of the readout address are masked, i.e. set to and held at 0. The resulting address value is 000000110100. The sum of this address value and the loop start address LSA, i.e. xxxx01000000 is equal to xxxx01110100, which is within the loop waveform data section defined by the loop start address LSA and the loop end address LEA.

This arrangement of the tone generator dispenses with complicated address-setting processing to repeatedly read out the loop section of the waveform data from the memory.

Preferably, the address-generating device includes an accumulator that accumulates a value of a pitch parameter in response to a clock to deliver an address cumulative value, and an adder that adds data of a modulating signal to the address cumulative value to prepare the readout address.

Further preferably, the determining device includes a sign-outputting device that outputs predetermined sign data when the readout address delivered from the adder exceeds the loop end address, and the address loop device includes a selector device that selectively delivers the looping readout address depending on the predetermined sign data from the sign-outputting device.

Alternatively, the determining device includes a sign-outputting device that outputs predetermined sign data when the readout address delivered from the adder falls below the loop start address, and the address loop device includes a selector device that selectively delivers the looping readout address depending on the predetermined sign data from the sign-outputting device.

Preferably, the address loop device includes a loading device that loads the sum of the value of $m\times2^n$ of the loop start address and the bit-masked address value into the accumulator to thereby set the address cumulative value to the sum of the value of $m\times2^n$ of the loop start address and the bit-masked address value.

Alternatively, the address loop device includes a loading device that loads the bit-masked address value into the accumulator to thereby set the address cumulative value to the bit-masked address value.

Further preferably, the waveform data is formed solely by the loop section, and the loop start address is identical with a start address of the waveform data.

Preferably, once the selector device selectively delivers the looping readout address, the selector device continuously delivers the looping readout address.

Alternatively, the selector device delivers the looping readout address only one time when the determining device determines that the readout address exceeds the loop start address.

Alternatively, the selector device delivers the looping readout address only one time when the determining device determines that the readout address falls below the loop start address or that the readout address exceeds the loop end address.

Further, to attain the object, the present invention provides a tone generating method comprising the steps of:

storing in memory means waveform data at least having a loop section defined by a loop start address and a loop end address for repetitive reading out;

generating a readout address by which the waveform data is read out from the memory means and for delivering the readout address for reading out the waveform data from the memory means;

masking a predetermined range of more significant bits of the readout address and for generating a bit-masked address value;

determining whether the readout address is within the loop section; and generating a looping readout address by the use of the bit-masked address value and delivering the looping readout address as the readout address, when it is determined that the readout address falls outside the loop section at least at one side of the loop start address and the loop end address of the loop section.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

In the figure, there is shown the arrangement of a tone generator according to a first embodiment of the invention.

Figure 1:
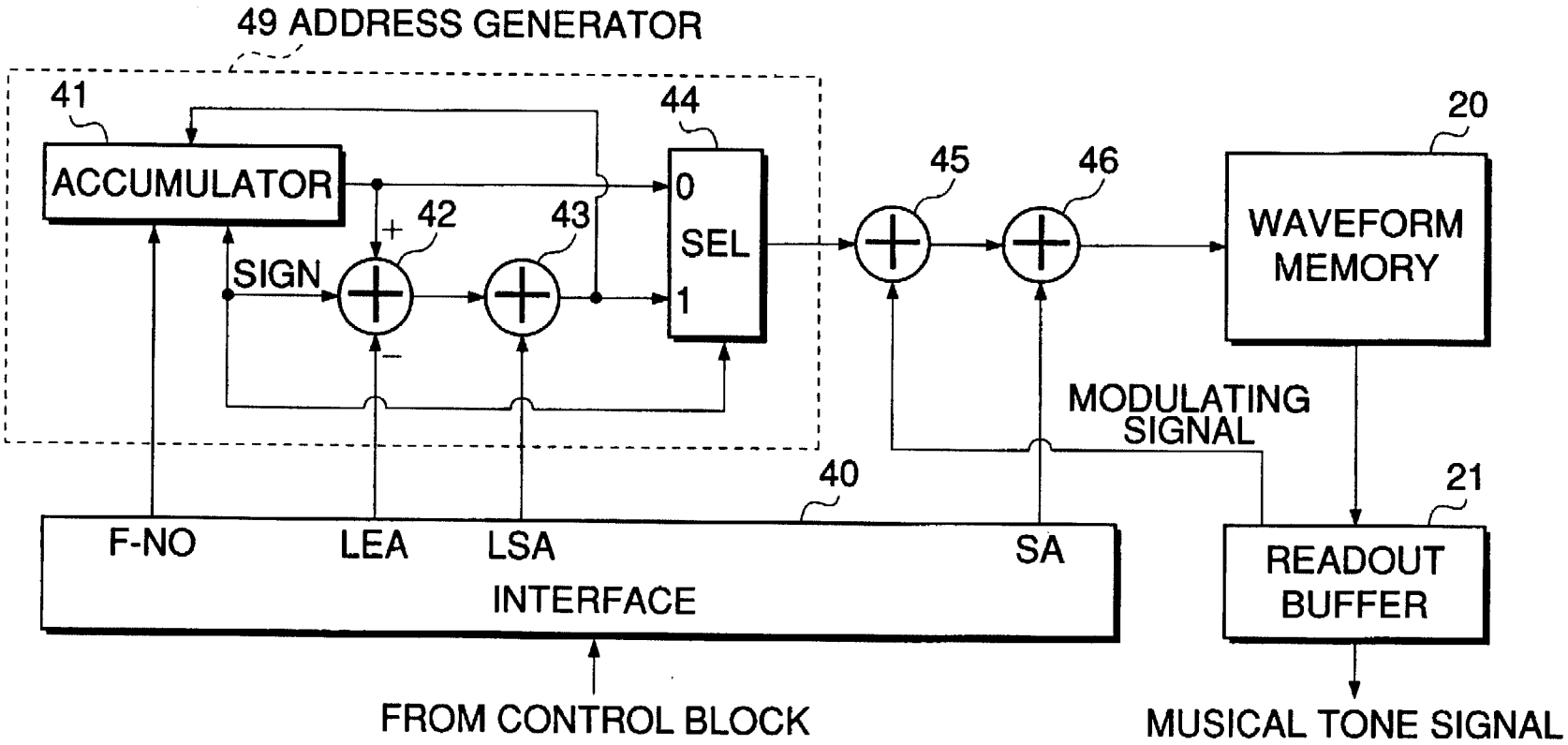
FIG.1 (PRIOR ART)
FIG. 1 is a block diagram showing the arrangement of a conventional tone generator.
Figure 2:
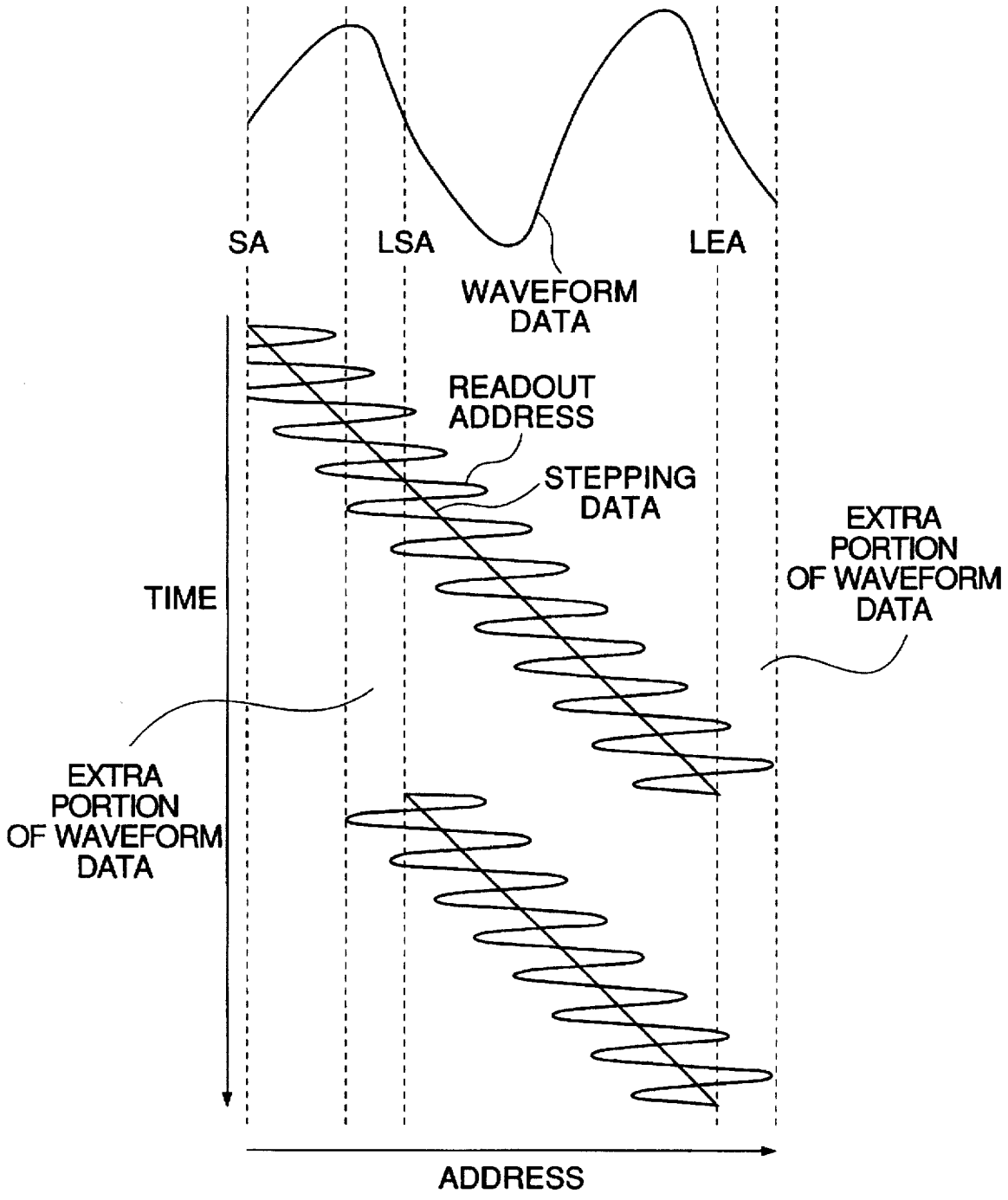
FIG.2 (PRIOR ART)
FIG. 2 is a diagram which is useful in explaining a manner of looping executed by the conventional tone generator.
Figure 3:
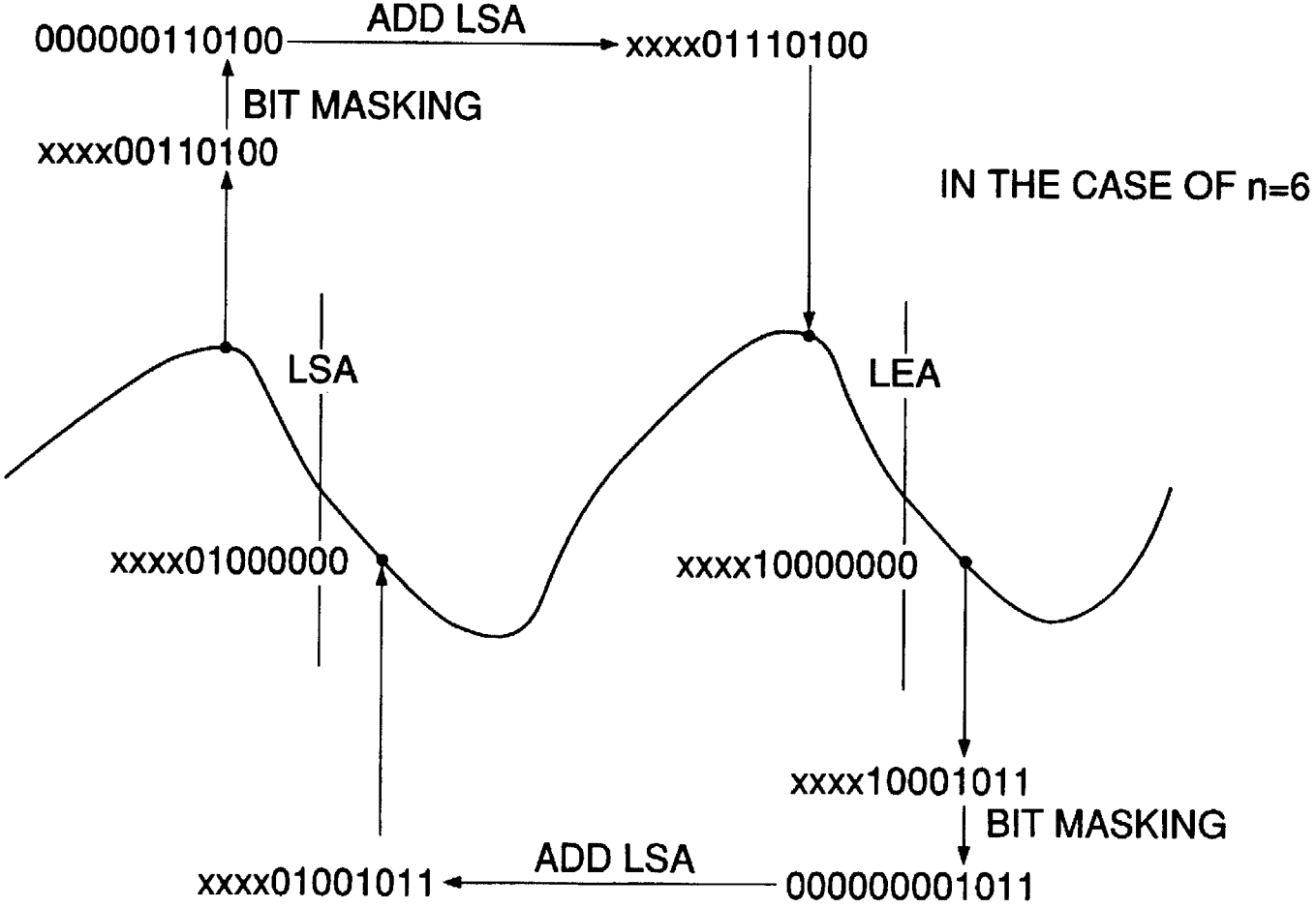
FIG. 3 is a diagram which is useful in explaining a method of looping, which is employed by a tone generator according to the invention.
Figure 4:
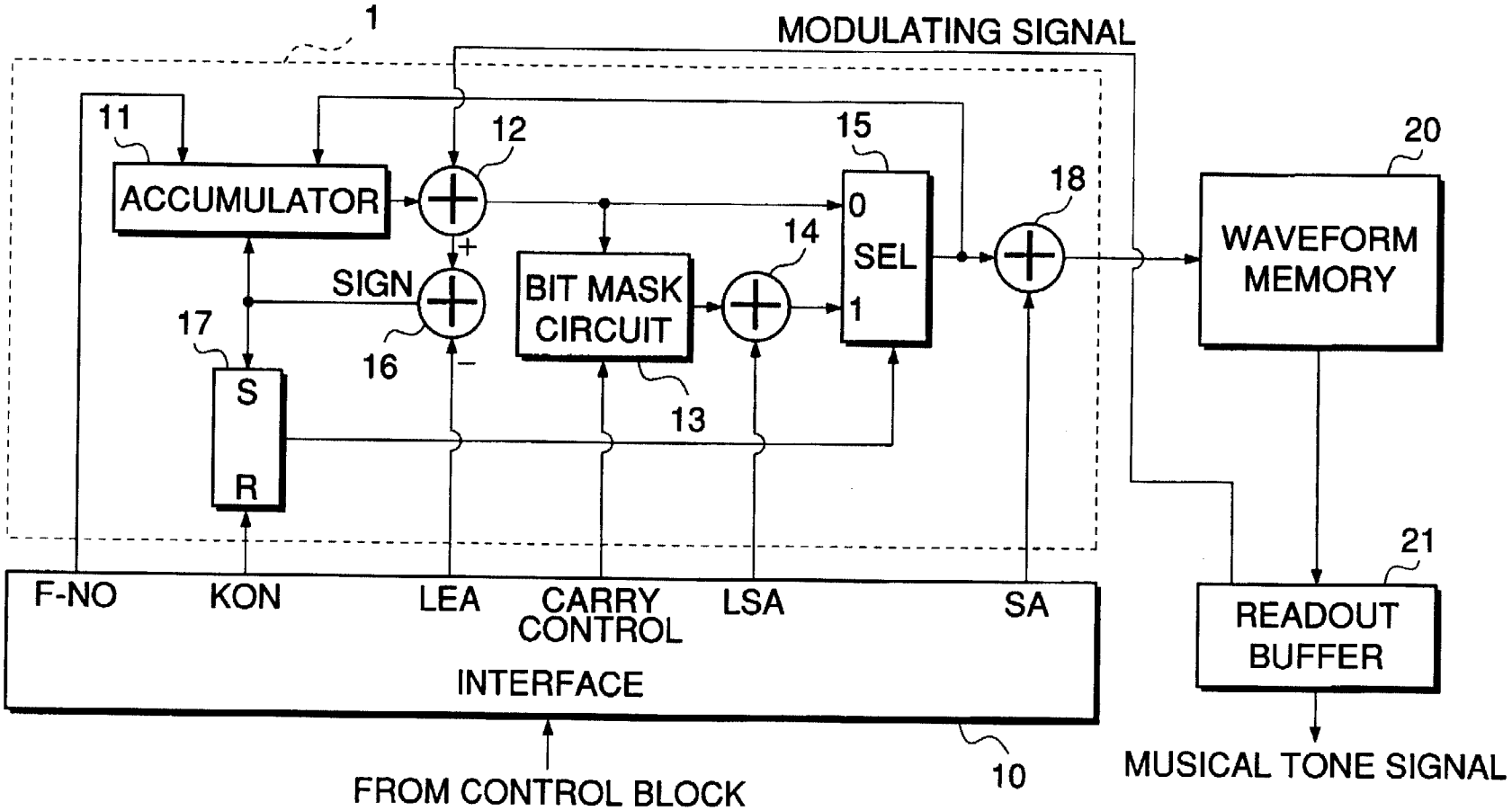
FIG. 4 is a block diagram showing the arrangement of a tone generator according to a first embodiment of the invention.

Referring to FIG. 4, the tone generator is comprised of a waveform memory 20 which stores waveform tables of waveform data of a plurality of tone colors including a loop waveform table, an address-generating circuit 1 for generating a readout address by which specific waveform data is sequentially read out from the waveform memory 20, a readout buffer 21 in which the data from the waveform memory 20 is temporarily stored, and an interface 10 via which tone color data and performance data are input to the address-generating circuit 1 from a control block, not shown.

The interface 10 supplies the address-generating circuit 1 with F number data F-NO and key-on data KON constituting the performance data, a start address SA (as an absolute address), a loop start address LSA (as a relative address with respect to the start address SA), a loop end address LEA (a relative address with respect to the start address SA), and carry control data of the tone color data, all of which are received from the control block, via terminals F-NO, KON, LEA, SA, LSA, and a carry control terminal, respectively.

The address-generating circuit 1 includes an accumulator 11 supplied with the F number data F-NO from the F-No terminal of the interface 10 for accumulating the same in response to clock pulses to generate and deliver a cumulative value thereof, an adder 12 connected to the accumulator 11 and the readout buffer 21 for adding a modulating signal input from the latter to the cumulative value input from the former to prepare and deliver a relative readout address, a selector 15 provided with a "0"-side input terminal via which the relative readout address is input from the adder 12 and a "1"-side input terminal via which a loop address is input from an adder 14, referred to below, for selectively delivering one of these input data via an output terminal thereof, and an adder 18 connected to an output terminal of the selector 15 and a SA terminal of the interface 10 to add the start address SA to the output from the selector 14 to generate and deliver the absolute address of the specific waveform data to the waveform memory 20.

The adder 12 is connected to an adder 16 and a bit mask circuit 13 as well, and loop processing is carried out based on results of a comparison between the relative readout address delivered from the adder 12 and the loop end address LEA, for repeatedly reading data of a loop section of the specific waveform data. More specifically, the loop end address LEA having a negative sign is input to the adder 16 from the LEA terminal of the interface 10, where it is added to the relative readout address, i.e. the loop end address LEA is subtracted from the relative readout address, and only the sign of results of calculation is delivered therefrom as sign data. That is, the adder 16 has an output terminal connected to a loading terminal of the accumulator 11 and a set terminal of a SR flip-flop circuit 17 for delivering the sign data indicative of the results of comparison in magnitude between the loop end address LEA and the relative read out address to the accumulator 11 and the SR flip-flop circuit 17. On the other hand, the bit mask circuit 13 is supplied with the carry control data from the carry control terminal of the interface 10 to set and hold more significant bits of the relative readout address designated by the carry control data to and at "0" and deliver the bit-masked data to the adder 14. The adder 14 adds the loop start address LSA input via the LSA terminal of the interface 10 to the bit-masked data from the bit mask circuit 13 to deliver the relative readout address subjected to bit-mask processing, i.e. the loop address to the "1"-input terminal of the selector 15.

The SR flip-flop circuit 17 has an output terminal thereof connected to a select terminal of the selector 15. When the sign data input from the adder 16 assumes a positive value, the flip-flop circuit 17 is set, and delivers data of "1" to the select terminal of the selector 15 to cause the same to select the loop address input via the "1"-side input terminal thereof. The SR flip-flop circuit 17 is reset in response to a KON signal indicative of the key-on data input via the KON terminal of the interface 10.

The accumulator 11 has a preset terminal thereof connected to the output terminal of the selector 15 for having the output from the selector 15 loaded thereinto when the sign data input thereto via the loading terminal thereof assumes a positive value.

Figure 5:
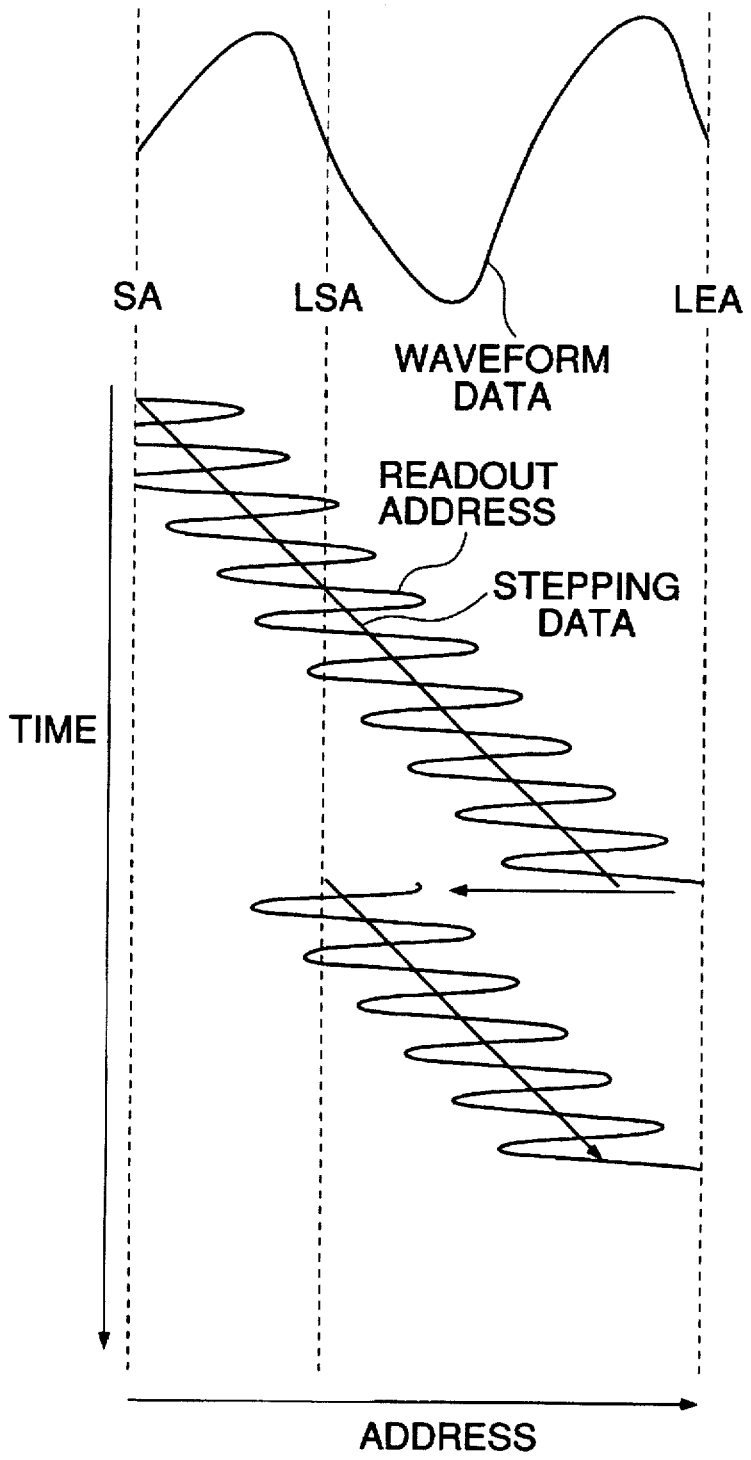
FIG. 5 is a diagram which is useful in explaining a manner of looping executed by the tone generator according to the first embodiment.

Next, the principle of a manner of loop processing according to the invention will be described with reference to FIG. 5. FIG. 5 shows how the readout address of a waveform memory of the tone generator is looped.

In the figure, the readout address by which the waveform memory 20 is accessed does not simply step forward, but instead, it advances in a manner shifting forward and backward alternately. The readout address thus shifting forward and backward is obtained by adding a modulating signal which assumes a positive value and a negative value alternately to stepping address data having an address value which steps forward at a constant rate. Waveform data is read out from the waveform memory according to the readout address thus obtained, and the waveform data read out is subjected to FM modulation. The readout address starts from the start address SA, and advances while shifting forward and backward alternately, as shown in the figure. Incidentally, in this example, it is assumed that in the event that the readout address obtained by the above calculation (addition) falls before the starting address SA, a predetermined processing is carried out e.g. by adding a predetermined address value to the sum. When the readout address reaches the loop end address LEA, the readout address is caused to jump toward the loop start address LSA. The readout address can go back to a location before the loop start address LSA due to the addition of the modulating signal thereto immediately after the jumping, but in such a case, the readout address is not made to jump toward the LEA side and instead, waveform data corresponding to the location slightly before the loop start address LSA is read out. This is because the start address SA is located before the loop start address LSA and hence waveform data exists at the location slightly before the loop start address LSA in the waveform memory.

Let it be assumed that the start address SA, the loop start address LSA, and the loop end address LEA are $4000_H$ (0100 0000 0000 0000), $5000_H$ (0101 0000 0000 0000), $5400_H$ (0101 0100 0000 0000), respectively, in terms of the absolute address. However, as described before, the loop start address LSA and the loop end address LEA are actually stored in terms of the relative address with respect to the start address SA assumed to have the address value of "0", as $1000_H$ (0001 0000 0000 0000) and $1400_H$ (0001 0100 0000 0000), respectively. If the memory size of the loop waveform table is set at $2^n$ and the loop start address is $m \times 2^n$, it is set such that n=10 and m=20 in the present embodiment. The readout address starts from the $4000_H$ [relative address: $0000_H$]. When the readout address reaches 5400H [1400H], the bit mask circuit 13 masks the more significant six bits, i.e. the eleventh and more significant bits. In short, the eleventh and more significant bits are set to and held at 0. This causes the bit mask circuit 13 to output data of $0000_H$. The sum of this value ($0000_H$) and the address value ($1000_H$) of the loop start address LSA gives $1000_H$, which is applied as the relative address of the loop start address LSA. When this relative address is output as the readout address, the relative address value is added to the absolute address value ($4000_H$) of the start address SA to give an absolute address value ($5000_H$) of the loop start address LSA, and then the waveform memory 20 is accessed by this absolute address. Thus, when the readout address reaches the loop end address LEA, more significant bits within a range from the most significant bit to a bit which differs between the loop start address LSA and the loop end address LEA are masked, whereby looping of the readout address is made possible to carry out in a simplified manner.

However, the loop start address LSA and the loop end address LEA are required to be equal in values of bits less significant than the differing bit, because the readout address should be caused to jump from the loop end address LEA toward the loop start address LSA, with the more significant bits being masked, and the less significant bits remaining equal between LSA and LEA.

The tone generator according to the present embodiment has 16 time-shared channels and are capable of generating a tone signal containing 16 tones at the same time. For simplicity sake, however, the following description refers to only one of the time-sharing channels, unless otherwise specified.

The operation of the tone generator according to the present embodiment will be described. Referring to FIG. 4, the interface 10 is supplied with tone color data and performance data from the control block. The tone color data is comprised of a start address SA, a loop start address LSA, a loop end address LEA, carry control data, etc. for reading out waveform data of a specific tone color, while the performance data is comprised of key-on data KON, F number data F-NO, etc. As described hereinbefore, the start address SA designates a start address of an area of the waveform memory storing the waveform data of the specific tone color, which is expressed as an absolute address designating the start address location within the waveform memory 20. The loop start address LSA and the loop end address LEA are relative addresses with respect to the start address SA assumed to have an address value of "0". The carry control data designates the number of the differing more significant bits which should be masked by the bit mask circuit 13 when looping of the waveform data is carried out. When the performance data is input, the tone generator starts sounding. The tone color data is input in advance or simultaneously with the performance data.

When the tone color data and the performance data are input to the interface 10, the interface 10 delivers the F number data F-NO to the accumulator 11. The accumulator 11 accumulates the F number data F-NO in response to clock pulses applied thereto and generates a cumulative value as stepping data. The stepping data is delivered to the adder 12. The adder 12 is supplied with the modulating signal from the readout buffer 21. The modulating signal gives address data obtained from waveform data read out into another time-shared channel of the tone generator and stored in the readout buffer 21. The sum of the cumulative value and the address data of the modulating signal is delivered as relative readout address data to the selector 15, the bit mask circuit 13, and the adder 16. The bit mask circuit 13 sets to and holds at "0" the more significant bits of the relative readout address input thereto, which are designated by the carry control data. The resulting data is delivered to the adder 14. The adder 14 is also supplied with the loop start address LSA from the interface 10, whereby the loop start address LSA is added to the data received from the bit mask circuit 13 to generate a looping readout address. The selector 15 receives the relative address at its "0"-side input terminal, and the looping readout address through its "1"-side input terminal.

The adder 16 compares the relative readout address with the loop end address LEA. When the relative readout address exceeds the loop end address LEA, the output value from the adder 16 changes into a positive value. Only a bit indicative of the sign of the output value from the adder 16 is applied to the set terminal of the SR flip-flop 17 and the loading terminal of the accumulator 11, as sign data. When the output value from the adder 16 becomes positive, the SR flip-flop 17 is set, whereby the accumulator 11 has the output from the selector 15 loaded thereinto as a preset value for starting the accumulation.

The SR flip-flop 17 is reset by the KON signal indicative of key-on data from the interface 10, so that at the beginning of sounding of a tone, the selector 15 selects the "0"-side input terminal and delivers the relative readout address received from the adder 12 to the adder 18. Thereafter, the relative readout address stepwise increases, and when it exceeds the loop end address LEA, the adder 16 delivers sign data indicative of the positive sign. The positive sign data is delivered to the SR flip-flop 17 to set the same. This causes the SR flip-flop 17 to deliver "1" to the selector 15. As a result, the selector 15 selects the "1"-side input terminal and delivers the looping readout address received from the adder 14 to the adder 18. The SR flip-flop 17 is not reset before a subsequent KON signal is input thereto, and hence looping readout addresses received via the "1"-side input terminal continue to be output from the selector 15 so long as the sounding of the present tone is continued.

The positive sign data from the adder 16 is applied to the loading terminal of the accumulator 11 as a loading trigger, in addition to setting the SR flip-flop 17. The accumulator 11 is triggered by the loading trigger to be loaded with the present output from the selector 15. As mentioned above, the data being currently output from the selector 15 is the looping readout address, i.e. (LSA)+(value represented by the unmasked less significant bits, which is equal between LSA and LEA). When loaded with the looping readout address, the accumulator 11 uses the looping readout address as the preset value, and thereafter accumulates the F number data F-NO thereon.

When the relative readout address increasing or stepping forward with accumulation of the F number data F-NO again exceeds the loop end address LEA, the adder 16 delivers the positive sign data in this case as well. Since the SR flip-flop 17 has already been set, this positive sign data does not cause any change in the state of the SR flip-flop 17, but the data is also input to the accumulator 11 as the loading trigger, as mentioned above. Therefore, the accumulator 11 is again loaded with the looping readout address output from the selector 15, whereby relative addresses of the loop section are repeatedly output.

The output data from the selector 15 is delivered to the adder 18, where the start address SA is added thereto. The adder 18 delivers the sum of the output data from the selector 15 and the start address SA as the readout address to the waveform memory 20 which in turn is accessed by the readout address to read out waveform data and store the same into the readout buffer 21. The waveform data stored in the readout buffer 21 is delivered to another circuit of the tone generator or used as a modulating signal for modulating waveform data read into another time-shared channel.

As described above, according to the present embodiment, whenever the readout address reaches the loop end address LEA, it is caused to jump back toward the loop start address LSA. This can dispense with the provision of waveform data corresponding to addresses beyond the loop end address LEA.

Further, although in the above described embodiment the F number data F-NO is assumed to have a positive integer, for simplicity sake, this is not limitative, but the F number data F-NO may have a value containing a fractional or decimal portion and accordingly the address delivered from the adder 18 has a fractional portion, in which case data stored at addresses corresponding to two integers adjacent to the calculated address value output from the adder 18 on both sides thereof may be read and an interpolation may be carried out by using the two pieces of data read out and the value of the fractional portion of the calculated address value.

Figure 6:
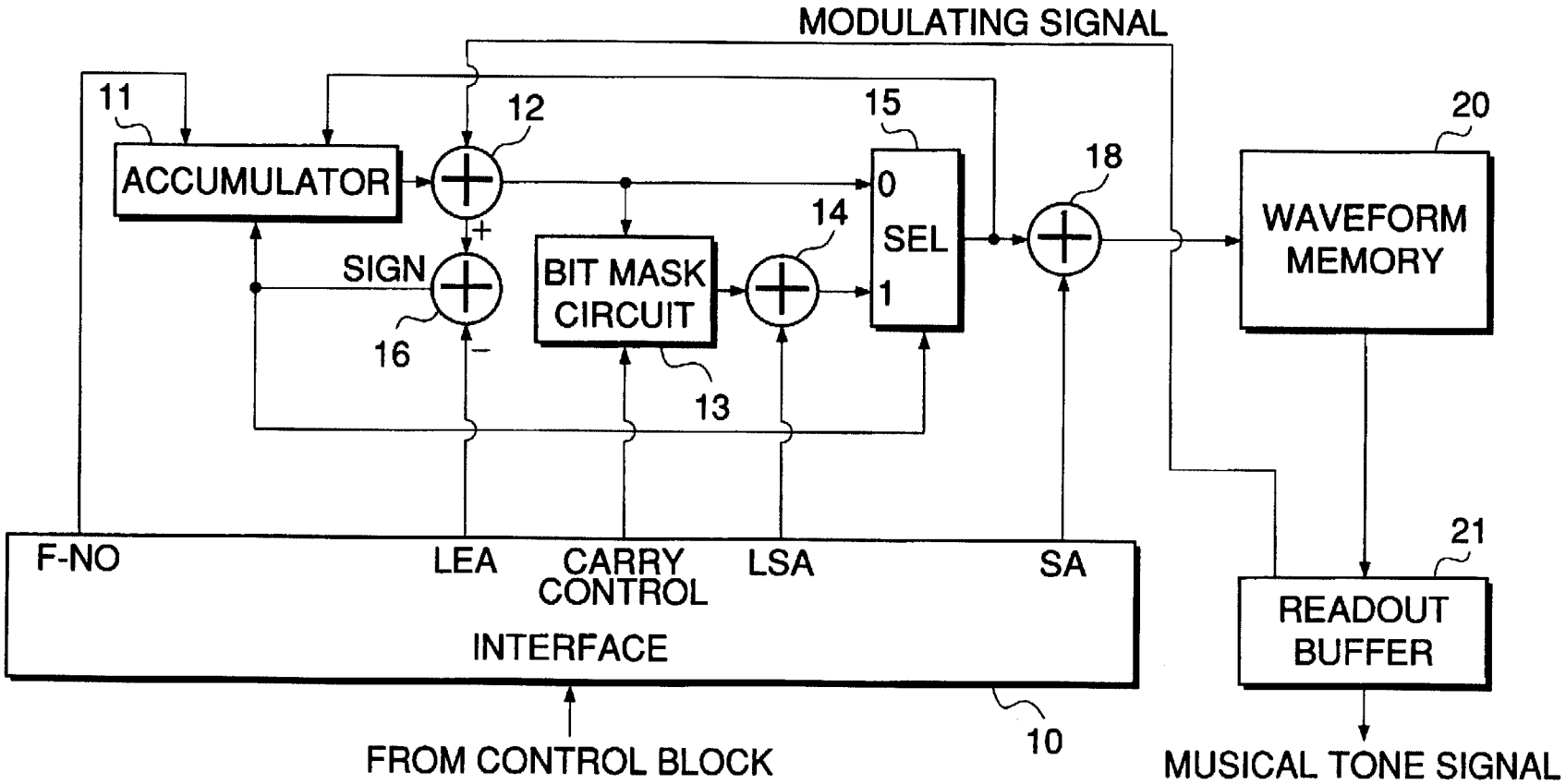
FIG. 6 is a block diagram showing the arrangement of a tone generator according to a second embodiment of the invention.

FIG. 6 shows the arrangement of a tone generator according to a second embodiment of the invention. This embodiment is distinguished from the first embodiment described above in that the SR flip-flop 17 is omitted from the tone generator of FIG. 4. According to the arrangement of the FIG. 4 circuitry, once the stepping data (relative readout address) has reached the loop end address LEA, the SR flip-flop 17 is held in the set state to hold the selector 15 in a state selecting the "1"-side input terminal. In contrast, according to the arrangement of the tone generator of FIG. 6, the selector 15 operates to select the "1"-side input terminal only when the stepping data (relative readout address) has reached the loop end address LEA so that the accumulator 11 is loaded with data with the more significant bits masked as described above. After this, the selector 15 continuously selects the "0"-side input terminal until the stepping data again reaches the loop end address LEA.

Figure 7:
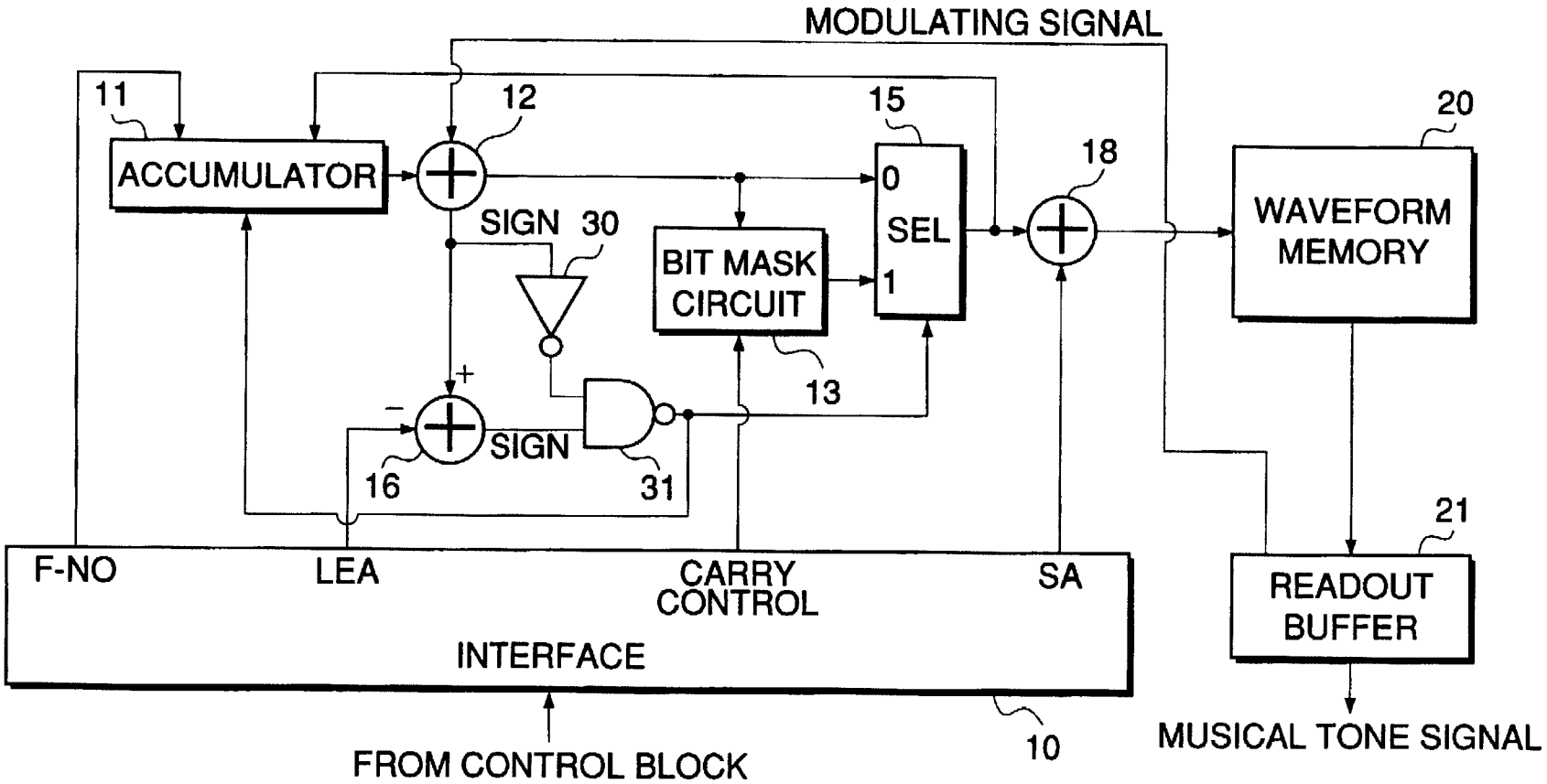
FIG. 7 is a block diagram showing the arrangement of a tone generator according to a third embodiment of the invention.
Figure 8:
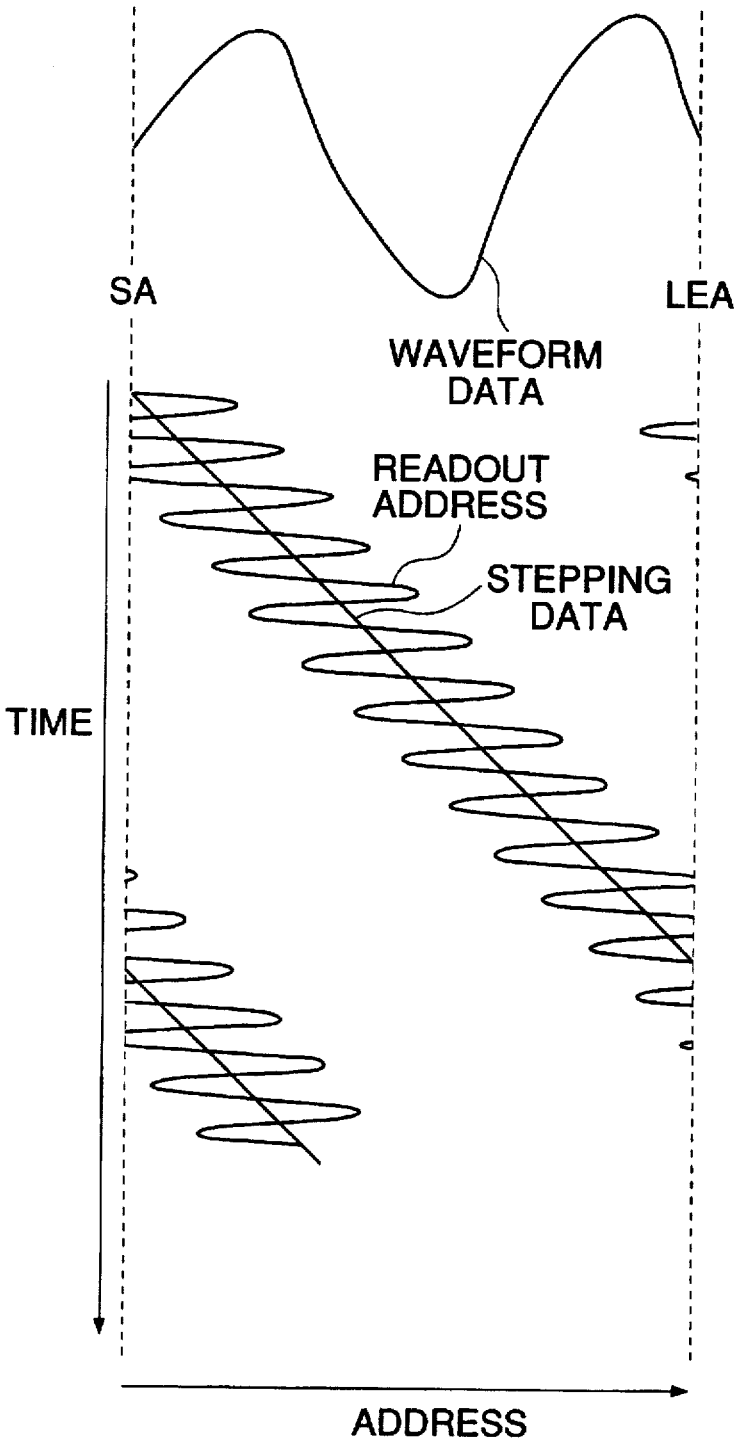
FIG. 8 is a diagram which is useful in explaining a manner of looping executed by the tone generator according to the third embodiment.

FIG. 7 shows the arrangement of a tone generator according to a third embodiment of the invention, and FIG. 8 shows a manner of looping carried out by this embodiment. This tone generator is an application of the invention which realizes an FM sound source by the use of waveform data formed of a loop section alone. If the waveform data is formed of the loop section alone, the absolute address of the loop start address LSA is identical with the start address SA, i.e. LSA=0. Therefore, when the readout address has reached the loop end address LEA, it is not only required that the readout address jumps from the loop end address LEA toward the start address SA, but also required that the readout address jumps from the start address SA toward the loop end address LEA if the sum of the stepping data and the modulating signal having a negative value results in the relative address assuming a negative value, i.e. the readout address falls before the start address SA.

To overcome this problem, according to the tone generator of the third embodiment, the adder 16 compares the value of the loop end address LEA with that of the relative address to output a sign indicative of a result of the comparison, and the sign of the relative address is extracted from the accumulated value from the adder 12 and inverted by an inverter 30. These signs from the adder 16 and the inverter 30 are subjected a NAND operation by a NAND circuit 31 which applies the NAND result to the loading terminal of the accumulator 11 and the select terminal of the selector 15. As a result, the selector 15 delivers data with masked bits to the adder 18 not only when the relative address has reached the loop end address LEA but also when the relative address assumes a negative value. In the latter case, since the data with the masked bits is selected by the selector 15 as the relative address, the readout address jumps from the start address SA side toward the loop end address LEA. Further, in this embodiment, the adder 14 is omitted since the loop start address LSA is not required to be added to the bit-masked data between the bit mask circuit 13 and the selector 15.

What is claimed is:

1. A tone generator comprising:

a memory for storing digital data representative of a waveform for repetitive retrieval of the digital data in response to a retrieval address, the memory having at least a loop section having a range defined by a loop start address and a loop end address;

a circuit for receiving data representative of performance information including the frequency of a musical tone to be generated by the tone generator;

an address-generating device for generating a step address based upon the frequency of the musical tone;

an address modulator for modulating the step address by a modulation signal to provide a modulated retrieval address;

a bit mask device for masking a predetermined range of most significant bits of the modulated retrieval address to generate a bit-masked address value;

a determining device for determining whether the modulated retrieval address is within the range of the loop section; and an address loop device for generating a looping retrieval address based upon the bit-masked address value as the retrieval address when the determining device determines that the modulated retrieval address is outside the range of the loop section.

2. A tone generator according to claim 1, wherein the loop start address is set to a value of $m\times2^n$ and the loop end address is set to a value of $(m+1)\times2^n$ to define the loop section as having a memory size of $2^n$, m and n being integers, and wherein the bit mask device sets n+1-th and most significant bits of the modulated retrieval address to 0 to thereby provide the bit-masked address value.

3. A tone generator according to claim 2, wherein when the determining device determines that the modulated retrieval address exceeds the loop end address, the address loop device adds the value of $m\times2^n$ of the loop start address to the bit-masked address value and provides the sum as the looping retrieval address.

4. A tone generator according to claim 2, wherein the address loop device adds the value of $m\times2^n$ of the loop start address to the bit-masked address value to provide the looping retrieval address when the determining device determines that the modulated retrieval address is less than the loop start address.

5. A tone generator according to claim 3, wherein the address-generating device includes an accumulator for accumulating a value of a pitch parameter in response to a clock signal to provide an address cumulative value, and wherein the address modulator includes an adder for adding data representative of the modulating signal to the address cumulative value to provide the modulated retrieval address.

6. A tone generator according to claim 4, wherein the address-generating device includes an accumulator for accumulating a value of a pitch parameter in response to a clock signal to provide an address cumulative value, and wherein the address modulator includes an adder for adding data representative of the modulating signal to the address cumulative value to provide the modulated retrieval address.

7. A tone generator according to claim 5, wherein the determining device includes a sign-outputting device for providing predetermined sign data when the the modulated retrieval address exceeds the loop end address, and wherein the address loop device includes a selector device for selecting the looping retrieval address as the retrieval address depending on the predetermined sign data.

8. A tone generator according to claim 5, wherein the determining device includes a sign-outputting device that outputs predetermined sign data when the modulated retrieval address is less than the loop start address, and wherein the address loop device includes a selector device for selecting the looping retrieval address as the retrieval address depending on the predetermined sign data from the sign-outputting device.

9. A tone generator according to claim 5, wherein the address loop device includes a loading device for loading the sum of the value of $m\times2^n$ of the loop start address and the bit-masked address value into the accumulator to thereby set the address cumulative value to the sum of the value of $m\times2^n$ of the loop start address and the bit-masked address value.

10. A tone generator according to claim 5, wherein the address loop device includes a loading device for loading the bit-masked address value into the accumulator to thereby set the address cumulative value to the bit-masked address value.

11. A tone generator according to claim 10, wherein the digital data is formed solely by the loop section, the loop start address being identical with a start address of the digital data.

12. A tone generator according to claim 7, wherein once the selector device selects the looping retrieval address as the retrieval address, the selector device continuously selects the looping retrieval address as the retrieval address.

13. A tone generator according to claim 7, wherein the selector device selects the looping retrieval address only one time when the determining device determines that the modulated retrieval address exceeds the loop start address.

14. A tone generator according to claim 7, wherein the selector device selects the looping retrieval address as the retrieval address only one time when the determining device determines that the modulated retrieval address is outside of the range of the loop section.

15. A tone generation method comprising the steps of:

storing digital data representative of a waveform in a memory for repetitive retrieval of the digital data in response to a retrieval address, the memory including at least a loop section, the loop section having a range defined by a loop start address and a loop end address;

receiving data representative of performance information including the frequency of a musical tone to be generated;

generating a step address based upon the frequency of the musical tone;

modulating the step address by a modulating signal to provide a modulated retrieval address;

masking a predetermined range of most significant bits of the modulated retrieval address for generating a bit-masked address value;

determining whether the modulated retrieval address is within the range of the loop section; and generating a looping retrieval address based upon the bit-masked address value as the retrieval address when the modulated retrieval address is outside the range of the loop section.

16. The method according to claim 15, the method further including:

defining the loop section as having a memory size of $2^n$ by setting the loop start address a value of $m\times2^n$ and setting the loop end address to a value of $(m+1)\times2^n$, m and n being integers; and setting n+1-th and most significant bits of the readout address to 0 to thereby provide the bit-masked address value.

17. The method according to claim 16, the method further including adding the value of $m\times2^n$ of the loop start address to the bit-masked address value and providing the sum as the looping retrieval address when the modulated retrieval address exceeds the loop end address.

18. The method according to claim 16, the method further including adding the value of $m\times2^n$ of the loop start address to the bit-masked address value to provide the looping readout address when the modulated retrieval address is less than the loop start address.

19. The method according to claim 17, the method further including:

accumulating a value of a pitch parameter in response to a clock signal to provide an address cumulative value; and adding data of the modulating signal to the address cumulative value to provide the modulated retrieval address.

20. The method according to claim 18, the method further including:

accumulating a value of a pitch parameter in response to a clock signal to provide an address cumulative value; and adding data representative of the modulating signal to the address cumulative value to provide the modulated retrieval address.

21. The method according to claim 19, the method further including:

providing predetermined sign data when the modulated retrieval address exceeds the loop end address; and selecting the looping retrieval address as the retrieval address depending on the predetermined sign data.

22. The method according to claim 19, the method further including:

providing predetermined sign data when the modulated retrieval address is less than the loop start address; and selecting the looping retrieval address as the retrieval address depending on the predetermined sign data from the sign-outputting device.

23. The method according to claim 19, the method further including loading the sum of the value of $m\times2^n$ of the loop start address and the bit-masked address value into an accumulator to thereby set the address cumulative value to the sum of the value of $m\times2^n$ of the loop start address and the bit-masked address value.

24. The method according to claim 19, the method further including loading the bit-masked address value into an accumulator to thereby set the address cumulative value to the bit-masked address value.

25. The method according to claim 24, the method further including:

formatting the digital data entirely within the loop section; and assigning the loop start address as a start address of the digital data.

26. The method according to claim 21, the method further including continuously selecting the looping retrieval address as the retrieval address once the looping retrieval address has been selected as the retrieval address.

27. The method according to claim 21, the method further including selecting the looping retrieval address as the retrieval address when the modulated retrieval address exceeds the loop start address.

28. The method according to claim 21, the method further including selecting the looping retrieval address as the retrieval address only one time when the modulated retrieval address is outside of the range of the loop section.

29. A tone generator comprising:

a memory for storing digital data representative of a waveform for repetitive retrieval of the digital data in response to a retrieval address, the memory having at least a loop section having a range defined by a loop start address and a loop end address;

an address-generating device for generating an initial address;

a bit mask device for masking a predetermined range of most significant bits of the initial address to generate a bit-masked address value;

a determining device for determining whether the initial address is within the range of the loop section; and an address loop device for generating a looping retrieval address based upon the bit-masked address value as the retrieval address when the determining device determines that the initial address is outside the range of the loop section, wherein the loop start address is set to a value of $m\times2^n$ and the loop end address is set to a value of $(m+1)\times2^n$ to define the loop section as having a memory size of $2^n$, m and n being integers, and wherein the bit mask device sets n+1-th and most significant bits of the initial address to 0 to thereby provide the bit-masked address value, and wherein when the determining device determines that the initial address exceeds the loop end address, the address loop device adds the value of $m\times2^n$ of the loop start address to the bit-masked address value and provides the sum as the looping retrieval address.

30. A tone generator according to claim 29, wherein the address-generating device includes:

an accumulator for accumulating a value of a pitch parameter in response to a clock signal to provide an address cumulative value; and an adder for adding data representative of a modulating signal to the address cumulative value to provide a modulated retrieval address.

31. A tone generator according to claim 30, wherein the determining device includes a sign-outputting device for providing predetermined sign data when the modulated retrieval address exceeds the loop end address, and wherein the address loop device includes a selector device for selecting the looping retrieval address as the retrieval address depending on the predetermined sign data.

32. A tone generator according to claim 30, wherein the determining device that outputs predetermined sign data when the modulated retrieval address is less than the loop start address, and wherein the address loop device includes a selector device for selecting the looping retrieval address as the retrieval address depending on the predetermined sign data from the sign-outputting device.

33. A tone generator according to claim 30, wherein the address loop device includes a loading device for loading the sum of the value of $m\times2^n$ of the loop start address and the bit-masked address value into the accumulator to thereby set the address cumulative value to the sum of the value of $m\times2^n$ of the loop start address and the bit-masked address value.

34. A tone generator according to claim 30, wherein the address loop device includes a loading device for loading the bit-masked address value into the accumulator to thereby set the address cumulative value to the bit-masked address value.

35. A tone generator according to claim 31, wherein once the selector device selects the looping retrieval address as the retrieval address, the selector device continuously selects the looping retrieval address as the retrieval address.

36. A tone generator according to claim 31, wherein the selector device selects the looping retrieval address only one time when the determining device determines that the modulated retrieval address exceeds the loop start address.

37. A tone generator according to claim 31, wherein the selector device selects the looping retrieval address as the retrieval address only one time when the determining device determines that the modulated retrieval address is outside of the range of the loop section.

38. A tone generator according to claim 34, wherein the digital data is formed solely by the loop section, the loop start address being identical with a start address of the digital data.

39. A tone generator comprising:

a memory for storing digital data representative of a waveform for repetitive retrieval of the digital data in response to a retrieval address, the memory having at least a loop section having a range defined by a loop start address and a loop end address;

an address-generating device for generating an initial address;

a bit mask device for masking a predetermined range of most significant bits of the initial address to generate a bit-masked address value;

a determining device for determining whether the initial address is within the range of the loop section; and an address loop device for generating a looping retrieval address based upon the bit-masked address value as the retrieval address when the determining device determines that the initial address is outside the range of the loop section, wherein the loop start address is set to a value of $m\times2^n$ and the loop end address is set to a value of $(m+1)\times2^n$ to define the loop section as having a memory size of $2^n$, m and n being integers, and wherein the bit mask device sets n+1-th and most significant bits of the initial address to 0 to thereby provide the bit-masked address value, and wherein the determining device determines when the initial address does not exceed the loop start address, and wherein the address loop device adds the value of $m\times2^n$ of the loop start address to the bit-masked address value to provide the looping retrieval address when the determining device determines that the initial address does not exceed the loop start address.

40. A tone generator according to claim 39, wherein the address-generating device includes:

an accumulator for accumulating a value of a pitch parameter in response to a clock signal to provide an address cumulative value: and an adder for adding data representative of a modulating signal to the address cumulative value to provide a modulated retrieval address.

* * * * *